United States Patent [19]

Harrington et al.

[11] 4,113,197

[45] Sep. 12, 1978

[54] CIGARETTE PAPER SPLICING APPARATUS

[75] Inventors: Timothy Cardell Harrington; Hugh MacDonald Arthur, both of London, England

[73] Assignee: Molins Limited, United Kingdom

[21] Appl. No.: 744,880

[22] Filed: Nov. 24, 1976

[30] Foreign Application Priority Data

Dec. 1, 1975 [GB] United Kingdom ..... 49266/75

[51] Int. Cl.[2] ..... B65H 19/14; B65H 69/06

[52] U.S. Cl. ..... 242/58.1; 156/504

[58] Field of Search ..... 242/58.1–58.5; 156/504

[56] References Cited

U.S. PATENT DOCUMENTS

| | | | |
|---|---|---|---|
| 2,724,426 | 11/1955 | Bell et al. | 156/504 X |
| 2,998,204 | 8/1961 | Walsh | 242/58.1 |
| 3,201,057 | 8/1965 | Ryan | 242/58.1 |
| 3,306,801 | 2/1967 | Giles | 242/58.3 X |
| 3,634,170 | 1/1972 | Hottendorf | 242/58.3 X |

*Primary Examiner*—Harvey C. Hornsby
*Assistant Examiner*—John M. Jillions
*Attorney, Agent, or Firm*—Craig & Antonelli

[57] ABSTRACT

Splicing apparatus for joining the paper web from successive reels in a cigarette or cigarette filter rod making machine includes provision for running each reel closer to the end in a controlled manner to reduce wastage of paper. For that purpose the diameter of the in-use reel may be monitored by an arm coupled to an electrical detector with an averaging or smoothing circuit so that a signal is obtained which is insensitive to reel non-circularity or eccentricity. Alternatively the end of the paper may be detected as a result of the loss of tension in the paper.

6 Claims, 7 Drawing Figures

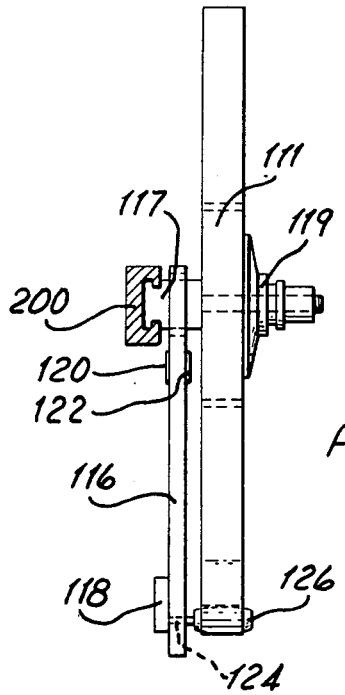
Fig. 6.
Fig. 7.
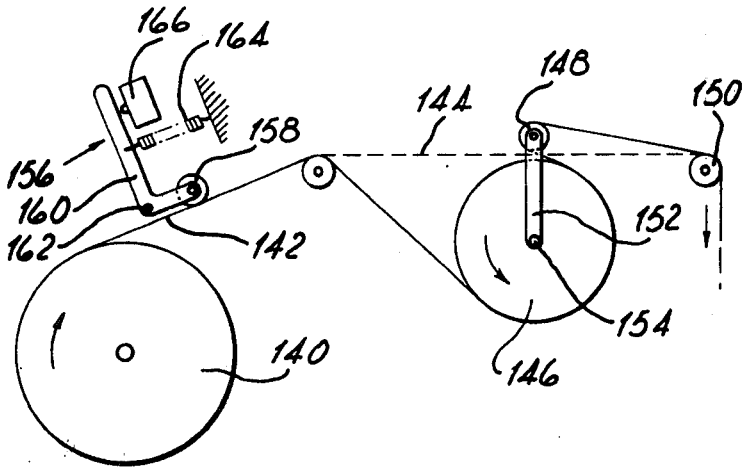

CIGARETTE PAPER SPLICING APPARATUS

This invention is concerned with web splicing. It is especially concerned with splicing (i.e., joining in any convenient way) webs of paper drawn from successive reels to form the wrapper of a cigarette or cigarette filter rod in a continuous rod making machine. Examples of earlier proposals are described in our British patent specifications Nos. 1,086,065, 1,161,781 and 1,345,701.

This invention is concerned particularly with the avoidance of waste. In some of our earlier proposals splicing is initiated when an arm bearing on the nearly spent reel indicates that very little paper is left on the reel. However, it has been found that a safety margin must be left in such an arrangement, and has resulted in wastage of paper.

A web splicing apparatus according to one aspect of this invention includes an arm arranged to bear against the in-use reel so as to move towards the centre of the reel as the paper on the reel is consumed, an electrical detector coupled to the arm and arranged to produce a variable electrical output or characteristic dependent upon the position of the arm, a smoothing or averaging device which smooths out or averages an electrical signal obtained by means of the electrical detector, and a splicing device arranged to join the web of the in-use reel to the leading end of the web on the stand-by reel when the signal from the smoothing or averaging device indicates that the in-use reel is nearly exhausted.

This contrasts with known arrangements in which a switch is used to detect the position of the arm. In such earlier proposals, if the reel is slightly out of round (i.e. elliptical) or if it is mounted slightly eccentrically on its spindle, then the switch can be operated when there is in fact a significant amount of paper left on the reel. Apparatus according to this aspect of the present invention, by providing an average indication of the diameter of the reel, is less subject to error on account of a slightly elliptical or eccentrically mounted reel; accordingly, it is possible to set the apparatus so as to perform the splicing operation when a smaller quantity of paper is left on the in-use reel, thus providing a saving of paper. Furthermore, it is possible, in carrying out the present invention, to use a simple but reliable electrical detector which provides a more accurately repeatable indication as to the quantity of paper left on the reel, being less prone to error through wear than in the case of the usual switches.

Apparatus according to this invention preferably includes a reservoir (e.g. as described in our British patent specification No. 1,086,065) and splicing takes place while both webs are stationary, during which time web for the continuously running rod making machine is drawn from the reservoir.

According to a second aspect of this invention, a web splicing apparatus comprises a web splicing device through which the web drawn from the in-use reel is arranged to pass; a movably mounted web guide around which the web is arranged to pass before reaching the web splicing device; means for urging the web guide towards the web; and means for detecting movement of the web guide when tension is lost in the web, indicating that the web is about to expire, and for thereupon initiating operation of the web splicing device to join the in-use web to the stand-by web.

Examples of web splicing apparatus according to this invention for splicing the paper web of a cigarette or cigarette filter rod making machine are shown diagrammatically in the accompanying drawings. In these drawings:

FIG. 6 is an enlarged end view of the reel in FIG. 4; and

FIG. 7 shows part of another different apparatus.

Figure 1:
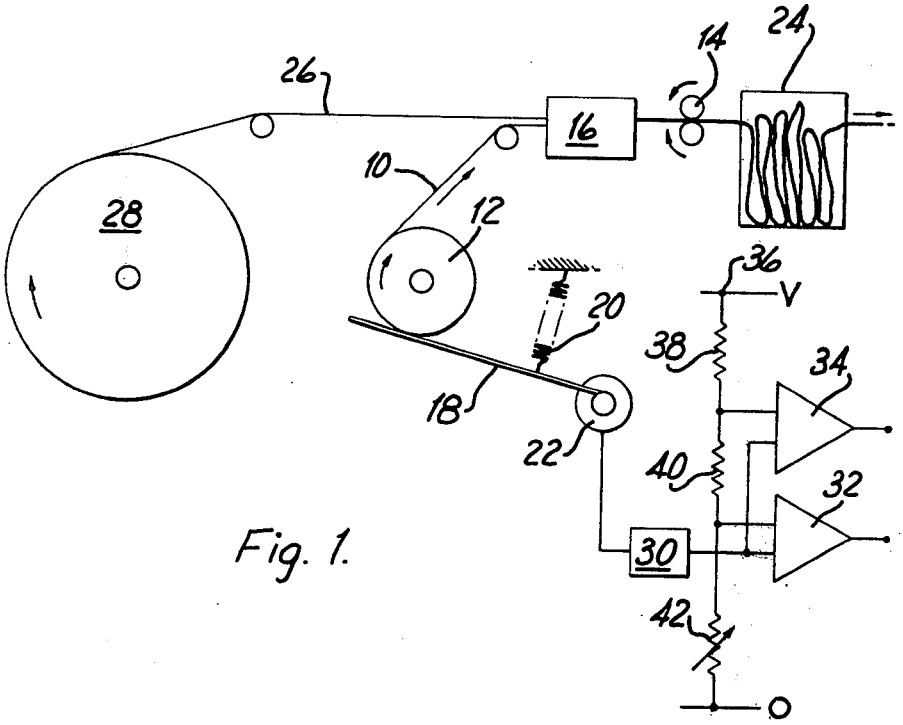
FIG. 1 is a diagrammatic illustration of an apparatus according to the first aspect of this invention.

FIG. 1 shows a paper web 10 being drawn from an in-use reel 12 by a pair of feed rollers 14 via a splicing device 16. A reel monitoring arm 18 is pressed against the reel 12 by a spring 20, the arm being pivotally mounted on the spindle of an electrical detector 22 in the form of a rotary transducer.

When a predetermined position of the arm 18 is reached, a signal from the transducer 22 results in the speed of the rollers 14 being increased by a predetermined percentage so as to over-feed the web 10, thus accumulating web in a reservoir 24; at this time the web continues to be drawn from the reservoir at the speed required by the cigarette or filter rod making machine. When the reel 12 is very nearly exhausted, the transducer 22 produces a second signal (in the manner described below) which results in the rollers 14 being stopped, whereupon the web 10 is joined by the device 16 to the leading end of a paper web 26 drawn from a stand-by reel 28.

The output from the transducer 22 is fed via a smoothing device in the form of a low-pass filter 30 to two direct current comparator amplifiers 32 and 34. Adjustable reference voltages are applied to the comparator amplifiers by means of a supply voltage applied to a terminal 36 and connected via resistors 38, 40 and 42 as shown in FIG. 1.

The comparator amplifier 32 produces an output signal when the arm 18 reaches the position at which the feed rollers 14 are to be speeded up; and the comparator amplifier 34 is set to provide an output signal when the reel 12 is about to expire.

The transducer 22 produces a direct current output. It may, for example, comprise a potentiometer. Alternatively, it may comprise a differential inductance or a differential capacitance, in which case an alternating current output is obtained which is then suitably converted into a direct current output.

Figure 2:
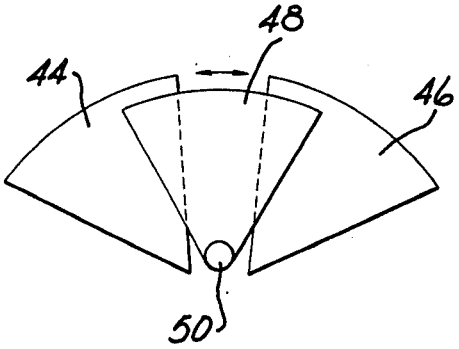
FIG. 2 is a diagrammatic view of one possible form of electrical detector used in the apparatus shown in FIG. 1.

FIG. 2 shows a possible differential capacitance for use as the detector 22 in FIG. 1. The capacitance comprises two fixed electrode plates 44 and 46 and a movable electrode plate 48 which is mounted on a spindle 50 which also carries the arm 18 shown in FIG. 1. Movement of the electrode plate 48 about the spindle 50 in one or other direction increases the capacitance between the plate 48 and one of the fixed plates while reducing the capacitance between the plate 48 and the other fixed plate. These two varying capacitances may be connected into a bridge circuit of a known type.

Each fixed capacitance electrode may comprise a number of parallel plates, the electrode 48 also being in the form of a number of parallel plates which are interleaved between the fixed plates.

Figure 3:
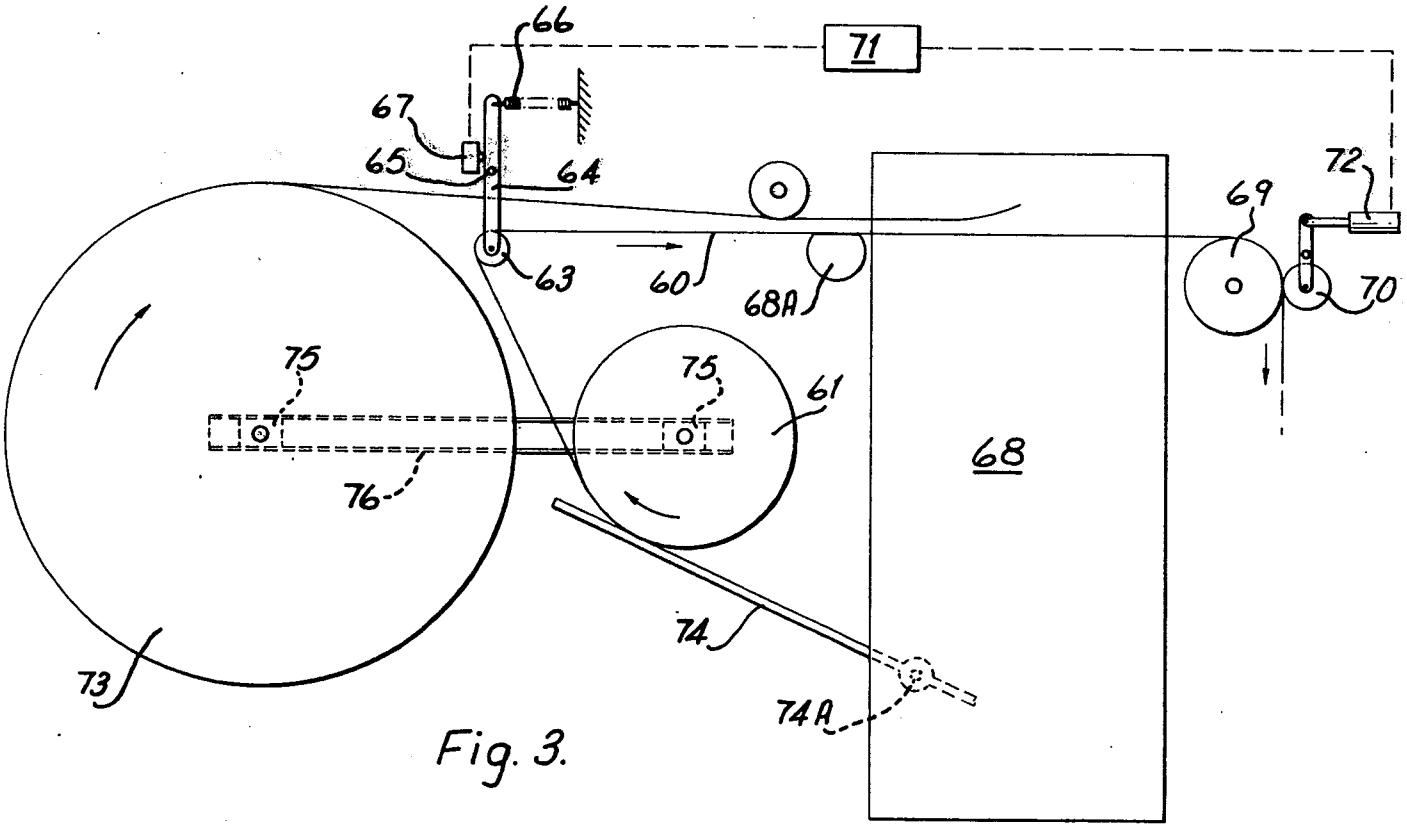
FIG. 3 is a diagrammatic illustration of a different apparatus according to the second aspect of this invention.

FIG. 3 shows diagrammatically a web joining apparatus in which operation of the web joining device is initiated by a guide detecting a loss of tension in the in-use web.

As shown in the drawings, a web 60 is being drawn from an in-use reel 61. The web 60 passes around a guide roller 63 mounted on a lever 64 pivoted at 65. A spring 66 urges the lever in a clockwise direction about the pivot 65.

It will be seen that the web 60 passes around the guide rollers 63 so that tension in the web urges the roller 63 to the right, thus tending to rotate the lever 64 in a counter-clockwise direction. As long as there is tension in the web 60, the lever 64 engages a switch 67. When tension is lost in the web 60, the lever rotates so as to disengage from the switch 67; this initiates operation of a web splicing device 68.

The web 60 is drawn through the web splicing device 68 by a driven roller 69 against which the web is pressed by a spring-loaded pinching roller 70. The web splicing device is basically as described in any one of the already-mentioned British patent specifications. That is to say, it includes a reservoir (not shown) into which the web passes after leaving the web splicing device and in which web can accumulate so that each web joining operation can take place while the in-use web (as well as the stand-by web) is stationary.

Disengagement of the lever 64 from the switch 67 causes operation of a valve 71 which feeds air to a cylinder 72 which then expands to move the pinching roller 70 away from the drive roller 69, thus stopping the drive to the web 60. Deceleration of the web is further aided by a suction brake 68A which may remain in operation permanently to keep the web in tension through the web splicing device 68.

The stand-by reel 73 is mounted in position only after the diameter of the in-use reel 61 has been reduced to a level (as indicated by an arm 74 pivoted at 74A) which allows room for the reel 73.

Each reel is mounted on a slider 75 which is movable along a track 76. When a reel is first brought into use (i.e. immediately after a web-joining operation) it is in the position of the reel 73 and is subsequently moved along the track 76 to the position occupied by the reel 61 in FIG. 3. As a result of this movement, the path of the web 60 (which previously produced little or no force on the guide roller 63) bends around the guide roller 63 so as to produce the required force on the guide roller as a result of the tension in the web. When the in-use reel is moved to the position occupied by the reel 61, the arm 74 is placed against the reel (as shown) and this operation prepares the circuit which will cause operation of the valve 71 when the lever 64 disengages from the switch 67.

Figure 4:
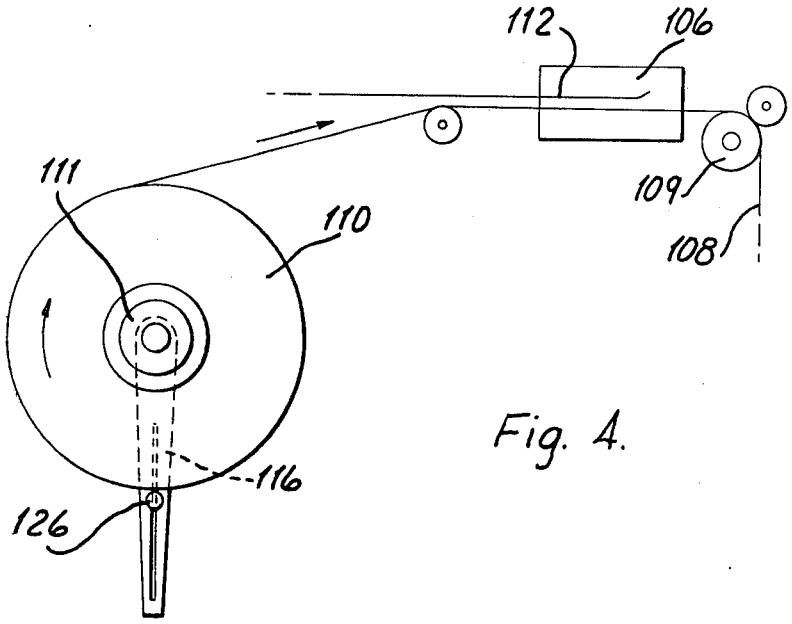
FIG. 4 is a diagrammatic view of part of another apparatus according to the second aspect of this invention, showing paper being drawn from a reel before it has been prepared for splicing.

FIG. 4 shows an apparatus including a splicing device 106 which may be in accordance with any one of the above-mentioned British patent specifications. A paper web 108 is drawn through the splicing device 106 by a driving roller 109 from a new reel 110, while the leading end 112 of paper from a stand-by reel 114 (see FIG. 5) is held in readiness to be joined to the trailing end of the paper from the reel 110 when the reel 110 is about to expire.

Figure 5:
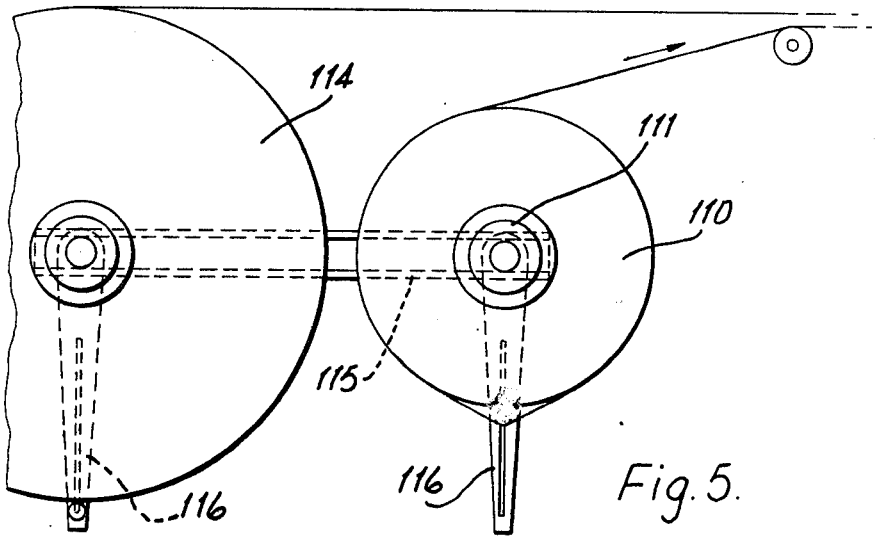
FIG. 5 shows the in-use reel in the apparatus of FIG. 4 after it has been prepared for splicing, and shows also a stand-by reel ready to be brought into use.

It should be understood that the reel 110 is shown in FIG. 5 some time after it has been spliced to the trailing end of the paper from the previous reel. Until that splicing operation, the reel 110 was mounted in the same position as the reel 114 shown in FIG. 5, at the left-hand end of a fixed track 115. After splicing, the in-use reel is moved to the right along the track 115 to the position occupied by the reel 110 in FIG. 5, and a new reel is subsequently mounted on the left-hand end of the track.

Behind each reel there is an arm 116 which is rotatable about the axis of the reel, but is normally locked to a slider 117 which carries reel holder 119. A block 118 is adjustable in position along the arm 116, being secured by fasteners (not shown) when in use, and carries a spindle 124 on which a barrel-shaped idler roller 126 is mounted, as shown particularly in FIG. 6.

Two similar strain gauges 120 and 122 are mounted on opposite faces of the arm 116, near the inner end of the arm, and are connected into an electrical bridge circuit (of a known kind) whereby a difference between the resistances of the two strain gauges can be monitored as an indication of the force of the paper web on the roller 126. It will be understood that this force tends to bend the arm very slightly; the strain gauges respond to the effect of this bending in a well-known manner.

In use, after the in-use reel has been moved along the track 115 to the position occupied by the reel 110 in FIG. 5, when the stand-by reel 114 is placed on the track 115, the block 118 is adjusted along the arm 116 to bring the roller 126 to a position close to the periphery of the reel, as shown in FIG. 4, and is then locked to the arm. Then the arm 116 is slowly rotated in a counter-clockwise direction (i.e. opposite to the direction of rotation of the reel) through one or more turns (preferably not more than four or five turns) so that the web passes around the roller 126, as shown in FIG. 5. The arm 116 is then locked in position on the slider 117 so that it is secured against rotation.

When the paper of the reel 110 is about to expire, the trailing end of the paper leaves the central hub 111 of the reel, thus releasing the tension in the downstream end portion of the paper. This reduces or (if only one revolution of the arm was performed) eliminates the force of the paper on the roller 126. By means of the strain gauges, this change is detected and a suitable control circuit is arranged immediately to stop the driving roller 109 and to initiate splicing by the device 106. The amount of paper discarded after splicing depends mainly on the number of revolutions of the arm 116 made during the initial setting up operation as described above; however, if the reel 110 is located a considerable distance from the splicing mechanism 106 then part of the paper run between the reel and the splicing device will also be discarded after splicing.

The apparatus shown in FIGS. 4 to 6 detects the end of the in-use reel of paper, but allows a predetermined short portion at the end of the reel to be discarded. This may be useful if (as sometimes happens) the paper at the end of each reel is of unacceptably poor quality. An alternative way of achieving this objective would be to use an apparatus like that shown in FIG. 3, except that the path for each of the webs between the associated reel and the splicing device includes a tortuous section (e.g. an adjustable zig-zag section around a number of rollers) serving as a buffer; in this case each web path should preferably include a separate tension-sensing guide member, and alternate reels are used in two different positions. An example of an adjustable buffer along these lines is shown in FIG. 7.

As shown in FIG. 7, a reel 140 has a paper web 142 drawn from it. The web 142 was initially fed along the dotted line 144 so as to pass between a pulley 146 and a movable pulley 148 and then round a further pulley 150. Subsequently the pulley 148, which is mounted on an arm 152 rotatable about the axis 154 of the pulley 146, was rotated by one revolution in a counter-clockwise direction so that the paper web 142 passes around just over half the periphery of the pulley 146. The pulley 148 may in fact be rotated slightly further about the axis 154, so long as the web downstream of the pulley 148 does not touch the pulley 146.

Immediately downstream of the reel 140 there is a tension sensing device 156 which detects the end of the paper on the reel 140. The device 156 acts by urging against the paper a roller 158 carried by a bent lever 160 pivoted at 162. A spring 164 acts on the lever 160 to urge the roller 158 against the paper web 142. As soon as tension drops in the web 142 (indicating that the reel 140 is exhausted), the spring 164 rotates the lever 160 in a clockwise direction and operates a switch 166 which immediately stops the pulley (not shown) pulling the web through the splicing device and initiates a splicing operation.

It will be understood that the arm 152 is locked in the position shown in FIG. 5 after being rotated to accumulate paper web around the pulley 146.

When the reel 140 expires, the trailing end of the web 142 is joined to the leading end of a web drawn from another reel (not shown) which is mounted in a different position and has a buffer 146, 148 and sensing device 156 like that shown in FIG. 7. The next full reel is then mounted in place of the expired reel 140, and the paper web drawn from it is fed to the splicing device (not shown) ready for the next splicing operation.

We claim:

1. A web splicing apparatus for joining the trailing end of a web on one reel (especially the paper web used as the cigarette wrapper in a continuous rod cigarette making machine) to the leading end of a web on a stand-by reel, comprising a web splicing device through which the web drawn from the in-use reel is arranged to pass; a movably mounted web guide means supporting both said reels such that both of the webs pass on the same side of said guide with the in-use web nearest to and tensioned around the guide, before reaching the web splicing device; means for urging the web guide towards the in-use web; means for detecting movement of the web guide when tension is lost in the in-use web, indicating that the web is about to expire, and for thereupon initiating operation of the web splicing device to join the in-use web to the stand-by web; and wherein said supporting means includes movable mounting means for supporting each reel so that each reel is movable between a first position which is occupied by the stand-by reel when web splicing is about to take place and a second position which is occupied by the in-use reel when web splicing is about to take place, and means operable after splicing to move the reel that is in use after splicing from the first position to the second position, such movement having the effect of changing the path of the web so that the in-use web engages the guide member and thereby resets the guide member.

2. A web splicing apparatus according to claim 1 in which the web splicing device includes a web reservoir for accumulating web prior to operation of the web splicing device, which operation is arranged to occur while the webs are stationary.

3. A web splicing apparatus according to claim 1, including a buffer associated with the in-use reel, so that operation of the web splicing device following loss of tension in the web leaves unused a predetermined length of the trailing end portion of the in-use web.

4. A web splicing apparatus according to claim 3 in which the buffer capacity is adjustable whereby the predetermined length of unused web can be altered.

5. A web splicing apparatus according to claim 1 wherein said detecting means comprises a switch which is spring-loaded so as to be actuated by movement of the web guide to disengage the drive to the web, when tension is lost in the web, the arrangement of the switch and the web guide being such that movement of the stand-by reel to the in-use position causes the web to engage the web guide and reset the switch to its original position.

6. A web splicing apparatus according to claim 1 in which the reels are slidable between the said two positions.

* * * * *